United States Patent [19]

Patrick

[11] 4,005,889

[45] Feb. 1, 1977

[54] SECURITY DEVICE FOR WINDOWS

[76] Inventor: Cecil W. Patrick, 6920 N. 16th, Lot 156, Omaha, Nebr. 68112

[22] Filed: Dec. 12, 1975

[21] Appl. No.: 640,237

[52] U.S. Cl. ..... 292/262; 292/305

[51] Int. Cl.[2] ..... E05C 17/30

[58] Field of Search ..... 292/DIG. 47, 305, 262, 292/265, 266, 267, 276

[56] References Cited

UNITED STATES PATENTS

| | | | |
|---|---|---|---|
| 469,769 | 3/1892 | Badgley | 292/305 |
| 1,581,185 | 4/1926 | Ellis | 292/262 |
| 2,912,268 | 11/1959 | Markovich | 292/262 |
| 3,287,050 | 11/1966 | Ferrante | 292/262 |
| 3,797,005 | 3/1974 | Schwarz | 292/262 |

*Primary Examiner*—Richard E. Moore

*Attorney, Agent, or Firm*—Zarley, McKee, Thomte & Voorhees

[57] ABSTRACT

A security device for windows comprising a first tube member pivotally secured at its lower end to the upper end of the lower window unit and having a second tube member slidably received on the upper end thereof. The upper end of the second tube member is pivotally secured to the window frame or to the upper end of the upper window unit. The first tube member has a plurality of spaced-apart openings formed therein which are adapted to receive a bolt extending therethrough. The window units may be moved relative to the window until the bolt engages the lower end of the second tube member to prevent further movement.

1 Claim, 4 Drawing Figures

SECURITY DEVICE FOR WINDOWS

BACKGROUND OF THE INVENTION

This invention relates to a security device and more particularly to a security device for windows.

Many attempts have been made to provide security devices which will limit or prevent unauthorized movement of windows so as to prevent unauthorized entry therethrough. Examples of such prior art devices are U.S. Pat. Nos. 429,167, 1,601,524, 1,838,713, 2,114,910, 2,714,033, 2,844,843, 3,136,290 and 3,512,821.

While the devices of the prior patents do prevent movement of windows or the like, the prior art devices are extremely complicated, difficult to install, and difficult to adjust. Further, the prior art devices do not have the ability to be conveniently used.

Therefore, it is a principle object of the invention to provide an improved security device for windows.

A further object of the invention is to provide an improved security device for windows including means for permitting the easy adjustment thereof to permit the window to be opened in predetermined amounts.

A still further object of the invention is to provide an improved security device for windows which is easily installed.

A further object of the invention is to provide an improved security device for windows which is economical.

A still further object of the invention is to provide a security device for windows having an aesthetic appearance.

A still further object of the invention is to provide a security device for windows which prevents unauthorized opening of the window.

A still further object of the invention is to provide a security device for windows which is durable in use.

These and other objects will be apparent to those skilled in the art.

DESCRIPTION OF THE PREFERRED EMBODIMENT

Figure 1:
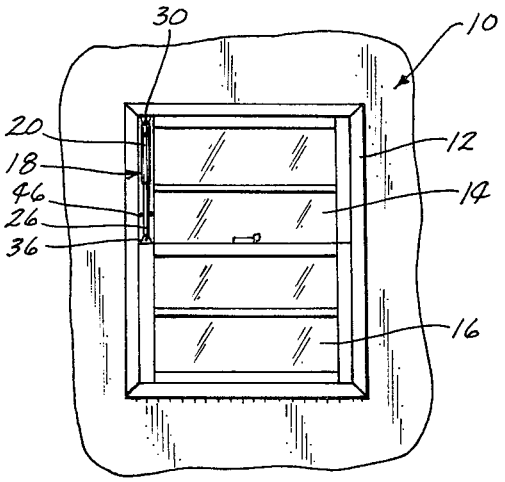
FIG. 1 is a plan view of the device mounted on a window.
Figure 2:
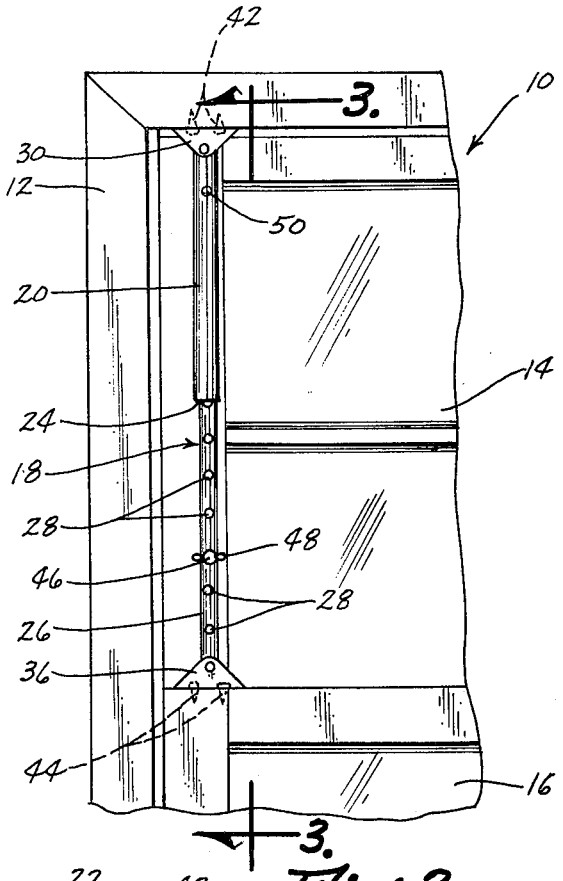
FIG. 2 is a partial plan view.
Figure 3:
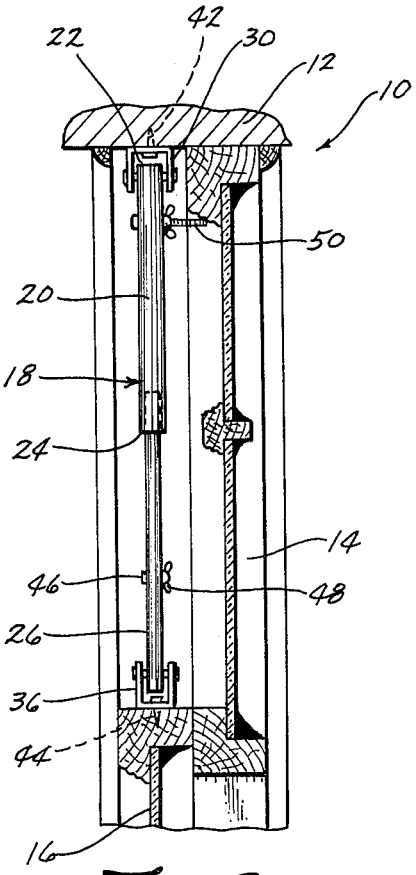
FIG. 3 is a sectional view seen on lines 3—3 of FIG. 2.
Figure 4:
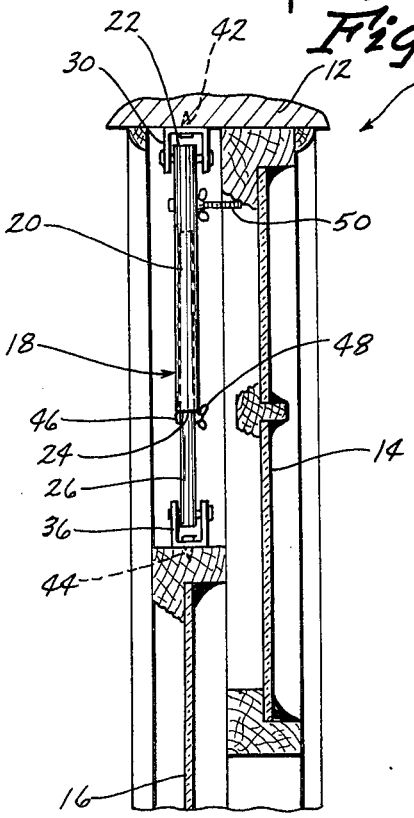
FIG. 4 is a sectional view similar to FIG. 3 illustrating the lower window in a partially raised position.

In the drawings, the numeral 10 refers generally to a window generally comprising a frame 12 having upper and lower window units 14 and 16 slidably mounted therein. The security device of this invention is referred to generally by the reference numeral 18.

Device 18 generally comprises an upper tubular member 20 having upper and lower ends 22 and 24 respectively. Lower tubular member 26 is slidably received by upper tubular member 20 and is provided with a plurality of spaced-apart bolt openings 28 formed therein and extending therethrough. Bracket 30 is pivotally secured to the upper end of tubular member 20 by means of bolt 32 and wing nut 34 while bracket 36 is pivotally secured to the lower end of tubular member 26 by bolt 38 and wing nut 40.

Bracket 30 may be secured to the window frame 12 by screws 42 as illustrated in FIG. 1 or may be secured to the upper end of the upper window unit 14 by screws 42 if desired. It is preferred that the bracket 30 be secured to the window frame 12 as shown in FIG. 1. Bracket 36 is secured to the upper end of lower window unit 16 by screws 44. The numeral 46 generally refers to a bolt which may be extended through any of the openings 28 and maintained therein by wing nut 48.

In use, the brackets 30 and 36 would be secured as previously described and would have the tubular members 20 and 26 pivotally secured thereto respectively. Bolt 46 is extended through the desired opening 28 and the wing nut 48 is threadably secured thereto. Thus, with the bolt 46 installed, the lower window unit 16 may be raised relative to the upper window unit 14 and relative to the frame 12 until the bolt 46 engages the lower end 24 of the upper tubular member 20. The engagement of the bolt 46 with the tubular member 20 prevent further movement of the window unit 16. It can be seen that a person could open the window 16 for ventilation purposes and would feel secure in the knowledge that the window could only be opened a predetermined amount thereby preventing unauthorized entry through the window. The position of the bolt 46 in the openings 28 permits the desired amount of permissible opening to be easily varied or changed by a person not being mechanically skilled.

The method of attaching the bracket 30 as seen in FIG. 1 would be in those installations wherein a storm window would be positioned outwardly of the upper window unit 14 so it is not imperative that movement of the window unit 14 be prevented. The alternate installation previously described would prevent relative movement of either the upper or lower window units.

A further means of preventing the movement of upper window unit 14 is the bolt 50 which extends through tubular member 20 and which has its inner end positioned in the movable path of window unit 14.

Thus it can be seen that an extremely simple and economical security device has been provided for preventing unauthorized entry through partially opened windows. The device is easily installed and is easily adjusted. It can therefore be seen that the device accomplishes at least all of its stated objectives.

I claim:

1. A security device for windows including at least a vertically movable lower window unit mounted in a window frame, comprising, a first upstanding tube means secured at its lower end to the upper end of the lower window unit, a second upstanding tube means slidably embracing the upper end of said first tube means and being secured at its upper end to said window frame, said first tube means having at least one opening formed therein between its lower end and the lower end of said second tube means, and a stop means in said opening adapted to engage the lower end of said second tube means when said lower window unit is raised thereby limiting the upward movement of said lower window unit, said first tube means being pivotally secured to said lower window unit, said second tube means being pivotally secured to said window frame, first and second U-shaped brackets being secured to said lower window unit and said window frame respectively by screws, said first tube means being pivotally secured to said first bracket, said second tube means being pivotally secured to said second bracket.

* * * * *